US005510016A

United States Patent [19]

Hilbert et al.

[11] Patent Number: 5,510,016

[45] **Date of Patent: *Apr. 23, 1996**

[54] GASOLINE UPGRADING PROCESS

[75] Inventors: Timothy T. Hilbert, Sewell; Dominick N. Mazzone, Wenonah; Michael S. Sarli, Haddonfield, all of N.J.

[73] Assignee: Mobil Oil Corporation, Fairfax, Va.

[ * ] Notice: The term of this patent shall not extend beyond the expiration date of Pat. No. 5,346,609.

[21] Appl. No.: 303,909

[22] Filed: Sep. 9, 1994

Related U.S. Application Data

[63] Continuation-in-part of Ser. No. 850,106, Mar. 12, 1992, Pat. No. 5,409,596, which is a continuation-in-part of Ser. No. 745,311, Aug. 15, 1991, Pat. No. 5,346,609.

[51] Int. Cl.[6] ..... C10G 69/02

[52] U.S. Cl. ..... 208/89; 208/212; 208/213

[58] Field of Search ..... 208/89

[56] References Cited

U.S. PATENT DOCUMENTS

| | | | |
|---|---|---|---|
| 3,957,625 | 5/1976 | Orkin | 208/211 |
| 4,211,640 | 7/1980 | Garwood et al. | 208/255 |
| 4,753,720 | 6/1988 | Morrison | 208/135 |
| 4,827,076 | 5/1989 | Kokayeff et al. | 208/212 |
| 4,950,387 | 8/1990 | Harande et al. | 208/49 |
| 5,346,609 | 9/1994 | Fletcher et al. | 208/89 |

*Primary Examiner*—Helane Myers
*Attorney, Agent, or Firm*—A. J. McKillop; M. D. Keen

[57] ABSTRACT

A process for catalytically desulfurizing cracked fractions in the gasoline boiling range to acceptable sulfur levels uses an initial hydrotreating step to desulfurize the feed with some reduction in octane number, after which the desulfurized material is treated with a self-bound or binder-free zeolite to restore lost octane. The process may be utilized to desulfurize catalytically and thermally cracked naphthas such as FCC naphtha as well as pyrolysis gasoline and coker naphthas, while maintaining octane so as to reduce the requirement for reformate and alkylate in the gasoline blend. The self-bound catalyst offers advantages in activity and permits the process to be carried out at lower temperatures.

20 Claims, 2 Drawing Sheets

Gasoline Octane
HDS/ZSM-5
HDS @ 700F
HDS/ZSM-5
HDS Alone
FEED
Clear Research Octane (A-316), R+0
Temperature, °F
102
100
98
96
94
92
90
450
500
550
600
650
700
750
800

GASOLINE UPGRADING PROCESS

CROSS REFERENCE TO RELATED APPLICATIONS

This application is a continuation-in-part of prior application Ser. No. 07/850,106, filed 12 Mar. 1992 now U.S. Pat. No. 5,409,596, which, in turn, is a continuation-in-part of prior application Ser. No. 07/745,311, filed 15 Aug. 1991, now U.S. Pat. No. 5,346,609, of which this application is also a continuation-in-part. The contents of Ser. Nos. 07/850,106 and 07/745,311 are incorporated in this application by reference.

FIELD OF THE INVENTION

This invention relates to a process for the upgrading of hydrocarbon streams. It more particularly refers to a process for upgrading gasoline boiling range petroleum fractions containing substantial proportions of sulfur impurities. Another advantage of the present process is that it enables the end point of catalytically cracked gasolines to be maintained within the limits which are expected for Reformulated Gasoline (RFG) under the EPA Complex Model.

BACKGROUND OF THE INVENTION

Catalytically cracked gasoline currently forms a major part of the gasoline product pool in the United States and it provides a large proportion of the sulfur in the gasoline. The sulfur impurities may require removal, usually by hydrotreating, in order to comply with product specifications or to ensure compliance with environmental regulations, both of which are expected to become more stringent in the future, possibly permitting no more than about 300 ppmw sulfur in motor gasolines; low sulfur levels result in reduced emissions of CO, $NO_x$ and hydrocarbons. In addition other environmental controls may be expected to impose increasingly stringent limits on gasoline composition. Currently, the requirements of the U.S. Clean Air Act and the physical and compositional limitations imposed by the Reformulated Gasoline (RFG) and EPA Complex Model regulations will result not only in a decrease in permissible sulfur levels but also in limitations on boiling range, typically measured by minimum Reid Vapor Pressure (RVP) and T90 specifications. Limitations on aromatic content may also arise from the Complex Model regulations.

Naphthas and other light fractions such as heavy cracked gasoline may be hydrotreated by passing the feed over a hydrotreating catalyst at elevated temperature and somewhat elevated pressure in a hydrogen atmosphere. One suitable family of catalysts which has been widely used for this service is a combination of a Group VIII and a Group VI element, such as cobalt and molybdenum, on a substrate such as alumina. After the hydrotreating operation is complete, the product may be fractionated, or simply flashed, to release the hydrogen sulfide and collect the now sweetened gasoline.

Cracked naphtha, as it comes from the catalytic cracker and without any further treatments, such as purifying operations, has a relatively high octane number as a result of the presence of olefinic components. In some cases, this fraction may contribute as much as up to half the gasoline in the refinery pool, together with a significant contribution to product octane. Other unsaturated fractions boiling in the gasoline boiling range, which are produced in some refineries or petrochemical plants, include pyrolysis gasoline and coker naphtha. Pyrolysis gasoline is a fraction which is often produced as a by-product in the cracking of petroleum fractions to produce light unsaturates, such as ethylene and propylene. Pyrolysis gasoline has a very high octane number but is quite unstable in the absence of hydrotreating because, in addition to the desirable olefins boiling in the gasoline boiling range, it also contains a substantial proportion of diolefins, which tend to form gums after storage or standing. Coker naphtha is similar in containing significant amounts of sulfur and nitrogen as well as diolefins which make it unstable on storage.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Various proposals have been made for removing sulfur while retaining the more desirable olefins. The sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

U.S. Pat. No. 4,049,542 (Gibson) discloses a process in which a copper catalyst is used to desulfurize an olefinic hydrocarbon feed such as catalytically cracked light naphtha. This catalyst is stated to promote desulfurization while retaining the olefins and their contribution to product octane.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Processes for improving the octane rating of catalytically cracked gasolines have been proposed. U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

The octane rating of the gasoline pool may be increased by other methods, of which reforming is one of the most common. Light and full range naphthas can contribute substantial volume to the gasoline pool, but they do not generally contribute significantly to higher octane values without reforming. They may, however, be subjected to catalytically reforming so as to increase their octane numbers by converting at least a portion of the paraffins and cycloparaffins in them to aromatics. Fractions to be fed to catalytic reforming, for example, with a platinum type catalyst, need to be desulfurized before reforming because reforming catalysts are generally not sulfur tolerant; they are usually pretreated by hydrotreating to reduce their sulfur content before reforming. The octane rating of reformate may be increased further by processes such as those described in U.S. Pat. Nos. 3,767,568 and 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components.

In application Ser. Nos. 07/850,106, filed 12 Mar. 1992, Ser. No. 07/745,311, filed 15 Aug. 1991(now U.S. Pat. Nos. 5,409,596 and 5,346,609), a process for the upgrading of gasoline by sequential hydrotreating and selective cracking steps is described. In the first step of the process, the naphtha is desulfurized by hydrotreating and during this step some loss of octane results from the saturation of olefins. The octane loss is restored in the second step by a shape-selective cracking, preferably carried out in the presence of an intermediate pore size zeolite such as ZSM-5. The product is a low-sulfur gasoline of good octane rating. Reference is made to Ser. Nos. 07/745,311 and 07/850,106 for a detailed description of these processes.

SUMMARY OF THE INVENTION

As shown in the prior applications referred to above, intermediate pore size zeolites such as ZSM-5 are effective for restoring the octane loss which takes place when the initial naphtha feed is hydrotreated. In the conventional manner, the catalysts comprise the zeolite component to provide the desired activity together with a binder or matrix material which is used to provide mechanical strength to the catalyst as well as enabling it to be formed into extrudates or other shaped forms which reduce the pressure drop in fixed bed reactors.

We have now found that in the process described in Ser. Nos. 07/850,106, filed 12 Mar. 1992, and 07/745,311, filed 15 Aug. 1991(now U.S. Pat. Nos. 5,409,596 and 5,346,609), it is desirable to use a catalyst which is free of the binder or matrix material. Catalysts of this type have a higher activity than bound catalysts and permit lower temperatures to be used during the processing over the zeolitic catalyst for octane restoration.

According to the present invention, therefore, a process for catalytically desulfurizing cracked fractions in the gasoline boiling range to acceptable sulfur levels uses an initial hydrotreating step to desulfurize the feed with some reduction in octane number, after which the desulfurized material is treated with a self-bound or binder-free zeolite to restore lost octane.

The process may be utilized to desulfurize catalytically and thermally cracked naphthas such as FCC naphtha as well as pyrolysis gasoline and coker naphthas, including light as well as full range naphtha fractions, while maintaining octane so as to reduce the requirement for reformate and alkylate in the gasoline blend. The use of the self-bound catalyst offers processing advantages in terms of catalyst activity and permits lower processing temeperatures to be used at this stage of the process. The higher activity also permits higher space velocities to be used, based on the total catalyst weight.

DETAILED DESCRIPTION

Feed

The feed to the process comprises a sulfur-containing petroleum fraction which boils in the gasoline boiling range, which can be regarded as extending from $C_6$ to about 500° F. although lower end points below the 500° F. end point are more typical. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (177° C.), for example, 95 percent points ($T_{95}$) of at least 380° F. (about 193° C.) or at least about 400° F. (about 220° C.). The process may be applied to thermally cracked naphthas such as pyrolysis gasoline, visbreaker naptha and coker naphtha as well as catalytically cracked naphthas such as FCC naphtha since both types are usually characterized by the presence of olefinic unsaturation and the presence of sulfur. From the point of view of volume, however, the main application of the process is likely to be with catalytically cracked naphthas, especially FCC naphthas and for this reason, the process will be described with particular reference to the use of catalytically cracked naphthas.

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F. (82° C.). Treatment of the lower boiling fraction in an extractive type process coupled with hydrotreating of the higher boiling component may therefore represent a preferred economic process option. Such a variant of the process is described in Serial No. 08/042,189, filed 30 Mar. 1993 (now U.S. Pat. No. 5,360,532) and 07/001,681, filed 7 Jan. 1993 (now U.S. Pat. No. 5,318,690). Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

Process Configuration

The selected sulfur-containing, gasoline boiling range feed is treated in two steps by first hydrotreating the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

The hydrotreated intermediate product which also boils in the gasoline boiling range (and usually has a boiling range which is not substantially higher than the boiling range of the feed), is then treated by contact with the zeolite beta catalyst under conditions which produce a second product comprising a fraction which boils in the gasoline boiling range which has a higher octane number than the portion of the hydrotreated intermediate product fed to this second step. The product form this second step usually has a boiling range which is not substantially higher than the boiling range of the feed to the hydrotreater, but it is of lower sulfur content while having a comparable octane rating as the result of the second stage treatment.

Hydrotreating

The temperature of the hydrotreating step is suitably from about 400° to 850° F. (about 220° to 454° C.), preferably about 500° to 800° F. (about 260° to 427° C.) with the exact selection dependent on the desulfurization desired for a given feed and catalyst. Because the hydrogenation reactions which take place in this stage are exothermic, a rise in temperature takes place along the reactor; this is actually favorable to the overall process when it is operated in the cascade mode because the second step is one which implicates cracking, an endothermic reaction. In this case, therefore, the conditions in the first step should be adjusted not only to obtain the desired degree of desulfurization but also to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l.^{-1}$), usually about 1000 to 2500 SCF/B (about 180 to 445 $n.l.l.^{-1}$) The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, although in most cases this will be as a down-flow, liquid phase, fixed bed process.

Octane Restoration—Second Step Processing

After the hydrotreating step, the hydrotreated intermediate product is passed to the second step of the process in which cracking takes place in the presence of the acidic catalyst comprising an intermediate pore size zeolite, preferably ZSM-5, although other zeolites of this type may also be used, for example, ZSM-11, ZSM-22, ZSM- 23, ZSM-35 or MCM-22. The effluent from the hydrotreating step may be subjected to an interstage separation in order to remove the inorganic sulfur and nitrogen as hydrogen sulfide and ammonia as well as light ends but this is not necessary and, in fact, it has been found that the first stage can be cascaded directly into the second stage. This can be done very conveniently in a down-flow, fixed-bed reactor by loading the hydrotreating catalyst directly on top of the second stage catalyst.

The conditions used in the second step of the process are selected to favor a number of reactions which restore the octane rating of the original, cracked feed at least to a partial degree. The reactions which take place during the second step which converts low octane paraffins to form higher octane products, both by the selective cracking of heavy paraffins to lighter paraffins and the cracking of low octane n-paraffins, in both cases with the generation of olefins. Ring-opening reactions may also take place, leading to the production of further quantities of high octane gasoline boiling range components. The catalyst may also function to improve product octane by dehydrocyclization/aromatization of paraffins to alkylbenzenes.

The conditions used in the second step are those which are appropriate to produce this controlled degree of cracking. Typically, the temperature of the second step will be about 300° to 900° F. (about 150° to 480° C.), preferably about 350° to 750° F. (about 177° C.) although the higher activity of the self-bound catalysts permits temperatures below 700° F. to be used with advantage. As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first stage will set the first stage exotherm and, therefore, the initial temperature of the second zone. Thus, the process can be operated in a completely integrated manner, as shown below.

The pressure in the second reaction zone is not critical since no hydrogenation is desired at this point in the sequence. The pressure will therefore depend mostly on operating convenience and will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with space velocities, typically from about 0.5 to 10 LHSV ($hr^{-1}$), normally about 1 to 6 LHSV ($hr^{-1}$). The self-bound catalysts permit higher space velocities to be used relative to the bound catalysts because of their higher zeolite content. Hydrogen to hydrocarbon ratios typically of about 0 to 5000 SCF/Bbl (0 to 890 $n.l.l.^{-1}$), preferably about 100 to 2500 SCF/Bbl (about 18 to 445 $n.l.l.^{-1}$) will be selected to minimize catalyst aging.

The use of relatively lower hydrogen pressures thermodynamically favors the increase in volume which occurs in the second step and for this reason, overall lower pressures are preferred if this can be accommodated by the constraints on the aging of the two catalysts, especially that of the zeolite catalyst. In the cascade mode, the pressure in the second step may be constrained by the requirements of the first but in the two-stage mode the possibility of recompression permits the pressure requirements to be individually selected, affording the potential for optimizing conditions in each stage, although, as stated above, lower pressures are favored for the second stage.

Consistent with the objective of restoring lost octane while retaining overall product volume, the conversion to products boiling below the gasoline boiling range ($C_5$–) during the second stage is held to a minimum. However, because the cracking of the heavier portions of the feed may lead to the production of products still within the gasoline range, no net conversion to $C_5$– products may take place and, in fact, a net increase in $C_5$+ material may occur during this stage of the process, particularly if the feed includes significant amount of the higher boiling fractions. It is for this reason that the use of the higher boiling naphthas is favored, especially the fractions with 95 percent points above about 350° F. (about 177° C.) e.g. above about 380° F. (about 193° C.) or higher, for instance, above about 400° F. (about 205° C.). Normally, however, the 95 percent point ($T_{95}$) will not exceed about 520° F. (about 270° C.) and usually will be not more than about 500° F. (about 260° C.).

The catalyst used in the second step of the process possesses sufficient acidic functionality to bring about the desired cracking reactions to restore the octane lost in the hydrotreating step. The preferred catalysts for this purpose are the intermediate pore size zeolitic behaving catalytic materials are exemplified by those acid acting materials having the topology of intermediate pore size aluminosilicate zeolites. These zeolitic catalytic materials are exemplified by those which, in their aluminosilicate form would have a Constraint Index between about 2 and 12. Reference is here made to U.S. Pat. No. 4,784,745 for a definition of Constraint Index and a description of how this value is measured. This patent also discloses a substantial number of catalytic materials having the appropriate topology and the pore system structure to be useful in this service.

The preferred intermediate pore size aluminosilicate zeolites are those having the topology of ZSM-5, ZSM-11, ZSM-12, ZSM-21, ZSM-22, ZSM-23, ZSM-35, ZSM-48, ZSM-50 or MCM-22. Zeolite MCM-22 is described in U.S. Pat. No. 4,954,325. Other catalytic materials having the appropriate acidic functionality may, however, be employed. A particular class of catalytic materials which may be used are, for example, the large pores size zeolite materials which have a Constraint Index of up to about 2 (in the aluminosilicate form). Zeolites of this type include mordenite, zeolite beta, faujasites such as zeolite Y and ZSM-4.

These materials are exemplary of the topology and pore structure of suitable acid-acting refractory solids; useful catalysts are not confined to the aluminosilicates and other refractory solid materials which have the desired acid activity, pore structure and topology may also be used. The zeolite designations referred to above, for example, define the topology only and do not restrict the compositions of the zeolitic-behaving catalytic components.

The preferred acidic component of the catalyst used in the second step is a zeolite such as ZSM-5. The aluminosilicate forms of this zeolite have been found to provide the requisite degree of acidic functionality and for this reason are the preferred forms of the zeolite. The aluminosilicate form of ZSM-5 is described in U.S. Pat. No. 3,702,886. Other isostructural forms of the zeolite containing other metals instead of aluminum such as gallium, boron or iron may also be used.

The acidic zeolite catalyst possesses sufficient acidic functionality to bring about the desired reactions to restore the octane lost in the hydrotreating step. The catalyst should have sufficient acid activity to have cracking activity with respect to the second stage feed (the intermediate fraction), that is sufficient to convert the appropriate portion of this material as feed, suitably with an alpha value of at least about 20, usually in the range of 20 to 800 and preferably at least about 50 to 200 (values measured prior to addition of the metal component). The alpha value is one measure of the acid activity of a catalyst; it is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$).

The alpha test is described in U.S. Pat. No. 3,354,078 and in J. Catalysis, 4, 527 (1965); 6, 278 (1966); and 61,395 (1980), to which reference is made for a description of the test. The experimental conditions of the test used to determine the alpha values referred to in this specification include a constant temperature of 538° C. and a variable flow rate as described in detail in J. Catalysis, 61,395 (1980).

The zeolite component of the catalyst is, according to the present invention, used without a binder or matrix material but, in order to minimize the pressure drop across the reactor, is formed into shaped particles such as extrudate or pellets, typically of at least 0.050 inch in diameter, typically of about 0.125 inch diameter in the case of cylinders (with other shapes, the maximum cross-sectional distance). The catalyst can be said to be binder-free or self-bound since it is formed into the desired shapes without the aid of the normal binder. The catalysts will therefore consist essentially of the zeolite itself or, when a metal component is used, of the zeolite plus tile metal component. In either case, no binder is present.

Methods for making catalyst particles consisting essentially of the crystalline zeolite are described in U.S. Pat. No. 4,582,815, to which reference is made for a description of the method. Briefly, the method described in that patent enables extrudates having high strength to be produced on conventional extrusion equipment by mulling the zeolite crystal with water to a solids level of 25 to 75 weight percent in the presence of 0.25 to 10 weight percent of a base such as sodium hydroxide (calculated as solid base, based on total solids content). Any metal component may be added in the muller.

The use of a metal component in addition to the acidic zeolite component may be desirable, as described in Ser. No. 07/850,106 to which reference is made for a description of the use of metal components such as nickel and noble metals such as platinum. A preferred metal component is molybdenum, as described in Ser. No. 08/303,908, filed 9 Sep. 1994, to which reference is made for a description of the use of molybdenum/ZSM-5 catalysts in this process. Molybdenum is suitably used in an amount from about 1 to 15 weight percent of the catalyst, more usually from 2 to 10 weight percent. The metal component has the capability of improving catalyst stability. When the metal can be incorporated by ion-exchange of a metal cation onto the zeolite, aging is likely to be reduced by inhibiting the deposition of coke in the internal pore structure of the zeolite. Metals such as nickel and platinum which can be put into aqueous solutions of their cations such as nickel nitrate and platinum ammine complexes can be used in this way.

The catalysts are used in the form of solid, shaped particles which may be cylindrical or polygonal in cross-section, for example, triangular, square or hexagonal or, alternatively, may be of polylobal configuration, e.g. cloverleaf.

The particle size and shape of the zeolite catalyst will usually be determined by the type of conversion process which is being carried out with operation in a down-flow, mixed (vapor/liquid) phase, fixed bed process being typical and preferred.

The advantage of the self-bound catalysts relative to the bound catalysts is that stability is improved since there is no place for coke to be deposited, blocking access to the zeolite component of the catalyst. The self-bound catalysts is also more active and can be operated at lower temperatures where thermal and catalytic side reactions are less prevalent: dealkylation as well as the production of light gas by non-selective cracking are likely to be less favored at the lower operating temeperatures associated with the self-bound zeolite catalysts.

The conditions of operation and the catalysts can be selected, together with appropriate feed characteristics to result in a product slate in which the gasoline product octane is not substantially lower than the octane of the feed gasoline boiling range material; for example, not lower by more than about 1 to 3 octane numbers, although slightly greater losses, typically 4 to 6 octane numbers, may be optimal from the economic point of view with highly olefinic feeds. It is preferred also that the volume of the product should not be substantially less than that of the feed, for example, from about 88 to 94 volume percent of the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

The operating conditions in the first and second steps may be the same or different but the exotherm from the hydrotreatment step will normally result in a higher initial temperature for the second step. Where there are distinct first and second conversion zones, whether in cascade operation or otherwise, it is often desirable to operate the two zones under different conditions. Thus the second zone may be operated at higher temperature and lower pressure than the first zone in order to maximize the octane increase obtained in this zone.

The second stage of the process should be operated under a combination of conditions such that at least about half (½) of the octane lost in the first stage operation will be recovered, preferably such that all of the lost octane will be recovered. In favorable cases, the second stage can be operated so that there is a net gain of at least about 1% in octane over that of the feed, which is about equivalent to a gain of about at least about 5% based on the octane of the hydrotreated intermediate. The process should normally be operated under a combination of conditions such that the desulfurization should be at least about 50%, preferably at least about 75%, as compared to the sulfur content of the feed.

EXAMPLES

The following examples illustrate the operation of the gasoline upgrading process using a ZSM-5 catalyst. In these examples, parts and percentages are by weight unless they are expressly stated to be on some other basis. Temperatures are in °F. and pressures in psig, unless expressly stated to be on some other basis.

In the following examples, unless it is indicated that there was some other feed, the same heavy cracked naphtha, containing 2% sulfur, was subjected to processing as set forth below under conditions required to allow a maximum of only 300 ppmw sulfur in the final gasoline boiling range product. The properties of this naphtha feed are set out in Table 1 below.

TABLE 1

| Heavy FCC Naphtha | |
|---|---|
| Gravity, °API | 23.5 |
| Hydrogen, wt % | 10.23 |
| Sulfur, wt % | 2.0 |
| Nitrogen, ppmw | 190 |
| Clear Research Octane, R + O | 95.6 |
| Composition, wt % | |
| Paraffins | 12.9 |
| Cyclo Paraffins | 8.1 |
| Olefins and Diolefins | 5.8 |
| Aromatics | 73.2 |
| Distillation, ASTM D-2887, °F./°C. | |
| 5% | 289/143 |
| 10% | 355/207 |
| 30% | 405/224 |
| 50% | 435/234 |
| 70% | 455/253 |
| 90% | 482/250 |
| 95% | 488/253 |

Table 2 sets out the properties of the catalysts used in the two operating conversion stages:

TABLE 2

| Catalyst Properties | HDS 1st stage Cat. | ZSM-5[1] 2nd. stage Cat. |
|---|---|---|
| Compn, wt % | | |
| Nickel | — | 1.0 |
| Cobalt | 3.4 | — |
| $MoO_3$ | 15.3 | — |
| Physical Properties | | |
| Particle Density, g/cc | — | 0.98 |
| Surface Area, $m^2/g$ | 260 | 336 |
| Pore Volume, cc/g | 0.55 | 0.65 |
| Pore Diameter, A | 85 | 77 |

[1]65 wt % ZSM-5 and 35 wt % alumina

Both stages of the process were carried out in an isothermal pilot plant at the same conditions in the following examples:

pressure of 600 psig, space velocity of 1LHSV, a hydrogen circulation rate of 3200 SCF/Bbl (4240 kPa abs, 1 $hr.^{-1}$ LHSV, 570 $n.l.l.^{-1}$). Experiments were run at reactor temperatures from 500° to 775° F. (about 260° to 415° C.).

In all the examples, the process was operated in a cascade mode with both catalyst bed/reaction zones operated at the same pressure and space velocity and with no intermediate separation of the intermediate product of the hydrodesulfurization.

Comparison Examples (HDS only)

BRIEF DESCRIPTION OF THE DRAWINGS

The process was operated with only a hydrodesulfurization reaction zone. At a reaction temperature of 550° F. (288° C.), the product had a sulfur content of about 300 ppmw, and a clear research octane of about 92.5. As the temperature of the desulfurization was increased, the sulfur content and the octane number continued to decline, as shown in FIGS. 1 and 2 (curves HDS Alone).

Examples of HDS followed by ZSM-5 upgrading with both beds at the same temperature.

Figure 1:
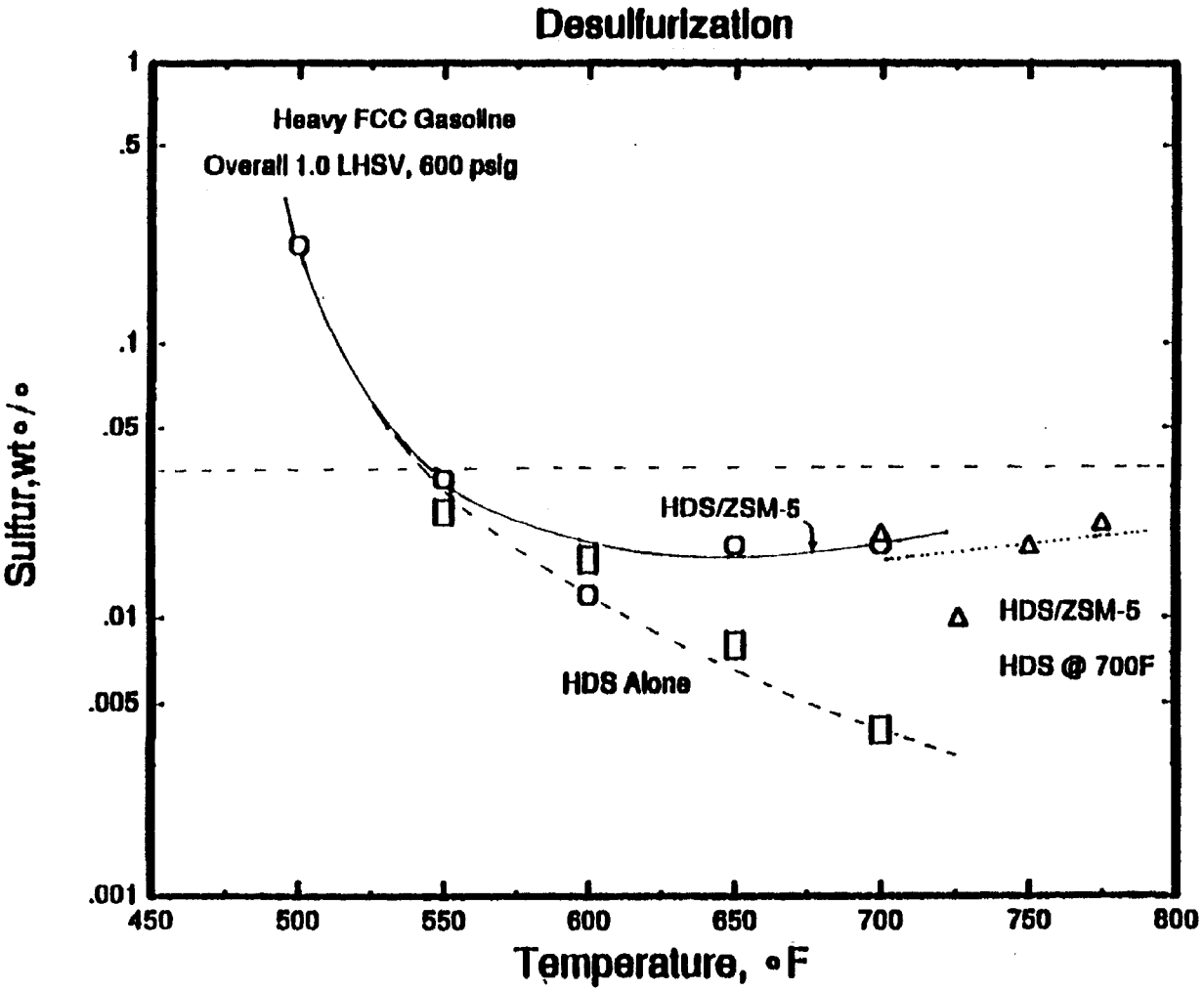
Figure 2:
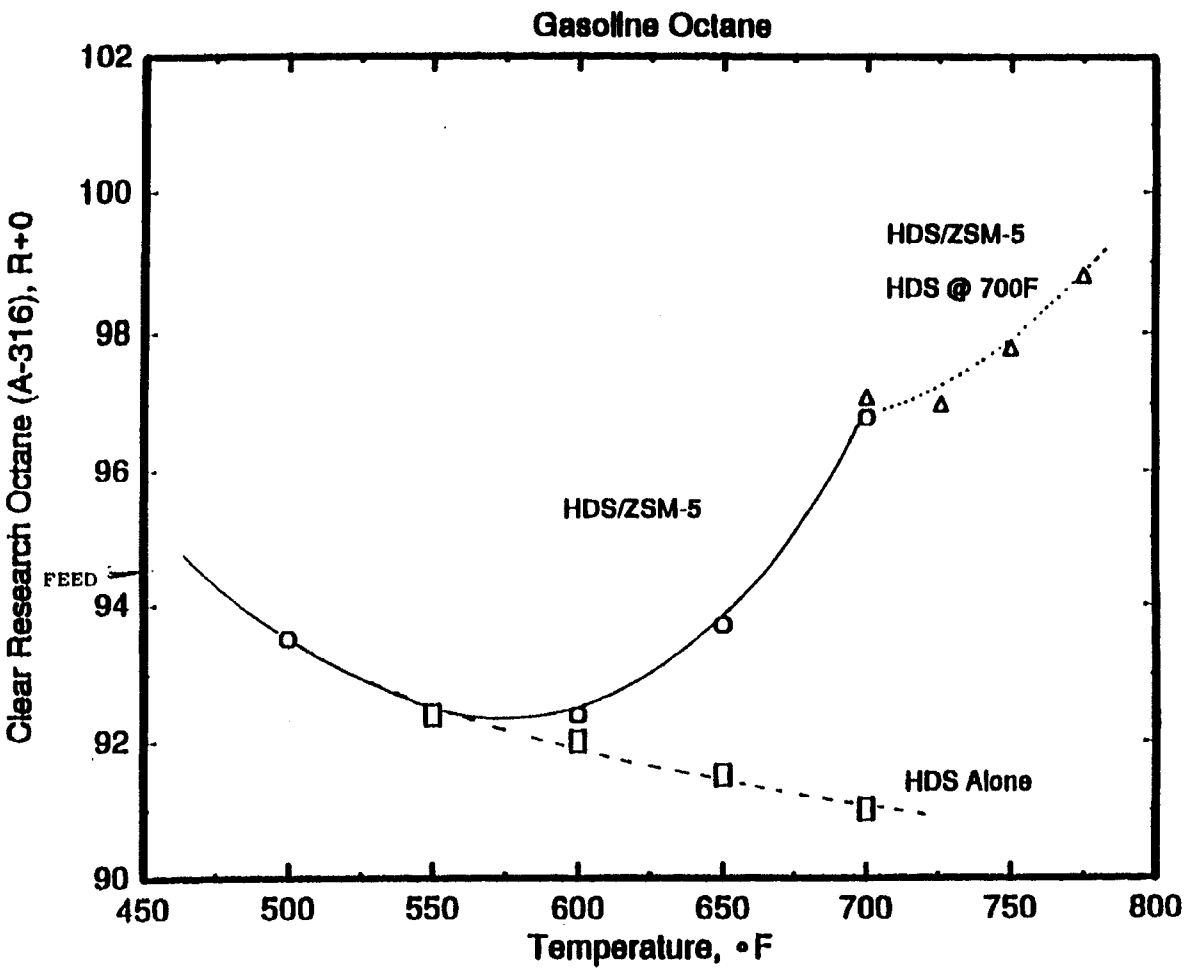

The hydrodesulfurization was run in cascade with ZSM-5 upgrading without intermediate hydrogen sulfide separation, with both beds under isothermal conditions. The results are again shown in FIGS. 1 and 2 (curves HDS/ZSM-5).

At a reaction temperature of 550° F. (288° C.), the product had slightly higher or about the same sulfur content as the hydrodesulfurization alone, that is a sulfur content of about 300 ppmw, and about the same clear research octane of about 92.5. As the temperature was increased to 600° F. (315° C.), the sulfur content of the product declined to about 200 ppmw, below that of the hydrodesulfurization alone; the octane number started to increase for the cascade operation as compared to the hydrodesulfurization alone.

When the operation was carried out at an operating temperature of 685° F. (363° C.), the octane number of the finished product was substantially the same as that of the feed naphtha, at 95.6 (clear-research), which is 4.6 octane units higher than the octane number for the same operation using only hydrodesulfurization without second step upgrading, while meeting the desired sulfur content specifications.

We claim:

1. In a process of upgrading a cracked, olefinic sulfur-containing feed fraction boiling in the gasoline boiling range by contacting the cracked, olefinic sulfur-containing feed fraction with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed; contacting at least the gasoline boiling range portion of the intermediate product in a second reaction zone with a catalyst comprising shaped particles of an acidic zeolite, to convert the gasoline boiling range portion of the intermediate product to a product comprising a fraction boiling in the gasoline boiling range having a higher octane number than the gasoline boiling range fraction of the intermediate product, the improvement comprising the use as the catalyst in the second reaction zone of a catalyst comrising shaped particles of a self-bound acidic zeolite.

2. The process as claimed in claim 1 in which the feed fraction comprises a full range catalytically cracked naphtha fraction having a boiling range within the range of $C_5$ to 420° F.

3. The process as claimed in claim 1 in which the feed fraction comprises a heavy catalytically cracked naphtha fraction having a boiling range within the range of 330° to 500° F.

4. The process as claimed in claim 1 in which the feed fraction comprises a heavy catalytically cracked naphtha fraction having a boiling range within the range of 330° to 412° F.

5. The process as claimed in claim 1 in which the feed fraction comprises a naphtha fraction having a 95 percent point of at least about 380° F.

6. The process as claimed in claim 5 in which the feed fraction comprises a naphtha fraction having a 95 percent point of at least about 400° F.

7. The process as claimed in claim 1 in which the feed fraction comprises a thermally cracked naphtha fraction.

8. The process as claimed in claim 7 in which the thermally cracked naphtha fraction comprises a coker naphtha.

9. The process as claimed in claim 1 in which the acidic zeolite is in the aluminosilicate form.

10. The process as claimed in claim 9 in which the acidic zeolite comprises ZSM-5.

11. The process as claimed in claim 1 in which the hydrodesulfurization is carried out at a temperature of about 400° to 800° F., a pressure of about 50 to 1500 psig, a space velocity of about 0.5 to 10 LHSV, and a hydrogen to hydrocarbon ratio of about 500 to 5000 standard cubic feet of hydrogen per barrel of feed.

12. The process as claimed in claim 1 in which the second stage upgrading is carried out at a temperature of about 300° to 900° F., a pressure of about 50 to 1500 psig, a space velocity of about 0.5 to 10 LHSV, and a hydrogen to hydrocarbon ratio of about 0 to 5000 standard cubic feet of hydrogen per barrel of feed.

13. The process as claimed in claim 12 in which the second stage upgrading is carried out at a temperature of about 350° to 900° F., a pressure of about 300 to 1000 psig, a space velocity of about 1 to 6 LHSV, and a hydrogen to hydrocarbon ratio of about 100 to 2500 standard cubic feet of hydrogen per barrel of feed.

14. The process as claimed in claim 1 which is carried out in cascade.

15. The process as claimed in claim 1 in which the shaped particles of the self-bound zeolite catalyst consist essentially of the acidic zeolite.

16. The process of claim 15 in which the shaped particles of the self-bound zeolite catalyst consist essentially of the acidic zeolite and a metal hydrogenation component.

17. The process as claimed in claim 15 in which the acidic zeolite comprises ZSM-5.

18. The process as claimed in claim 16 in which the acidic zeolite comprises ZSM-5.

19. The process as claimed in claim 1 in which the particles of the self-bound zeolite catalyst are formed by the extrusion of a mixture of the zeolite with water in the presence of a basic material.

20. The process as claimed in claim 19 in which the basic material comprises sodium hydroxide which is present in an amount from 0.25 to 10 weight percent based on the total solids.

* * * * *